US008627950B2

(12) United States Patent
Bland

(10) Patent No.: US 8,627,950 B2
(45) Date of Patent: Jan. 14, 2014

(54) HANGING FABRIC JEWELRY ORGANIZER

(75) Inventor: Z. Lavern Bland, Grandview, MO (US)

(73) Assignee: Z. Lavern Bland, Grandview, MO (US)

( * ) Notice: Subject to any disclaimer, the term of this patent is extended or adjusted under 35 U.S.C. 154(b) by 0 days.

(21) Appl. No.: 13/367,657

(22) Filed: Feb. 7, 2012

(65) Prior Publication Data

US 2012/0205262 A1 Aug. 16, 2012

Related U.S. Application Data

(60) Provisional application No. 61/463,278, filed on Feb. 15, 2011.

(51) Int. Cl.

| | |
|---|---|
| ***A45C 11/04*** | (2006.01) |
| ***A47F 7/02*** | (2006.01) |
| ***A47F 5/08*** | (2006.01) |
| ***B65D 30/22*** | (2006.01) |
| ***B65D 33/14*** | (2006.01) |

(52) U.S. Cl.

USPC ..... 206/6.1; 206/495; 211/85.2; 211/113; 383/40

(58) Field of Classification Search

USPC ..... 206/6.1, 278–286, 495, 806; 211/85.3, 211/113, 85.2; 383/40

See application file for complete search history.

(56) References Cited

U.S. PATENT DOCUMENTS

| | | | | |
|---|---|---|---|---|
| 3,862,687 | A * | 1/1975 | Pirman | 211/113 |
| 5,246,103 | A * | 9/1993 | Hicks | 206/6.1 |
| 5,427,230 | A * | 6/1995 | Mattox | 206/6.1 |
| 5,779,033 | A * | 7/1998 | Roegner | 206/6.1 |
| 6,874,624 | B2 * | 4/2005 | Redzisz | 206/278 |
| 7,059,073 | B2 * | 6/2006 | Beach | 206/495 |
| 7,438,194 | B2 * | 10/2008 | Wang | 211/113 |
| 7,896,152 | B1 * | 3/2011 | Bruhl | 206/6.1 |

* cited by examiner

*Primary Examiner* — Bryon Gehman

(57) ABSTRACT

A fabric jewelry organizer including a fabric surface having a fabric flap on each edge. A plurality of horizontal pockets on the flaps;

a plurality of horizontal support bars mounted in the pockets. A closure at a top edge of each flap and a hanger held in the organizer by the closures such that the hanger can be used to support the organizer.

12 Claims, 6 Drawing Sheets

HANGING FABRIC JEWELRY ORGANIZER

CROSS REFERENCES TO RELATED APPLICATIONS

Applicant claims priority under 35 USC 119e to provisional application 61/463,278 filed Feb. 15, 2011.

STATEMENT AS RIGHTS TO INVENTIONS MADE UNDER FEDERALLY SPONSORED RESEARCH AND DEVELOPMENT

Not applicable.

BACKGROUND OF THE INVENTION

1. Field of the Invention

This present invention relates generally to jewelry organizer.

2. Background Information

People who like jewelry often have multiple items of jewelry including earrings, rings, bracelets, necklaces and other items. Traditional jewelry boxes and jewelry armoires are used and the problem with this is that jewelry gets tangled and that jewelry sets, such as earring pairs, get separated. It is not unusual for people to have dozens or even hundreds of items.

Design Pat. No. 315,839 discloses a jewelry organizer. The organizer includes a hanger similar to what might be used in a closet. The organizer allows items to be hung on small hooks mounted on the organizer. While this organizer is useful it is limited in where it can be hung and in how jewelry is organized and displayed on the device.

SUMMARY OF THE INVENTION

The present invention solves the problems outlined above.

A fabric jewelry organizer including, a fabric surface including a fabric flap on each edge.

A plurality of horizontal pockets on the flaps;

a plurality of horizontal support bars mounted in the pockets.

A closure at a top edge of each flap and a hanger held in the organizer by the closures such that the hanger can be used to support the organizer.

DESCRIPTION OF THE PREFERRED EMBODIMENTS

Figure 1:
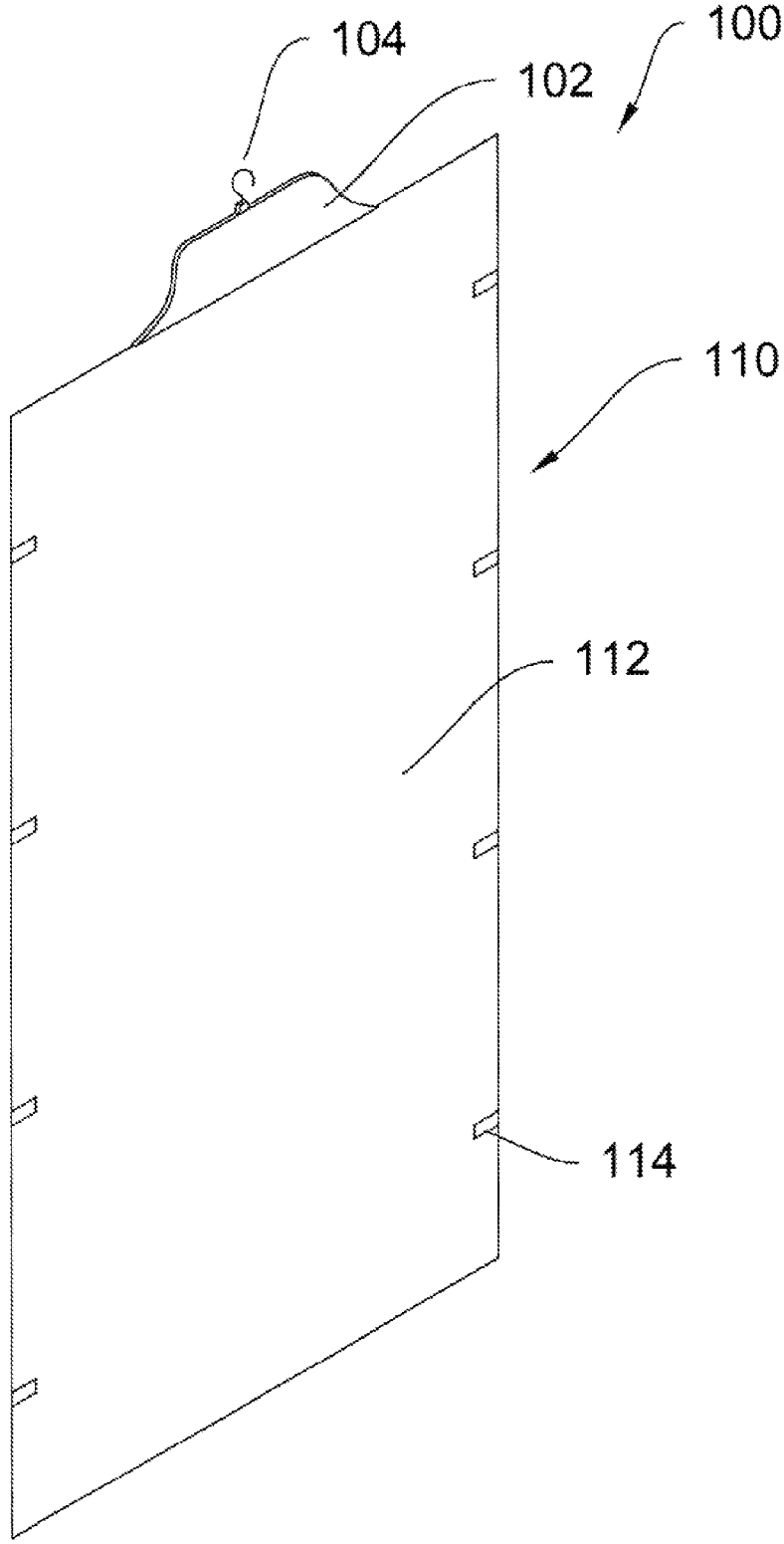
FIG. 1 is a view of a first side of the device.
Figure 2:
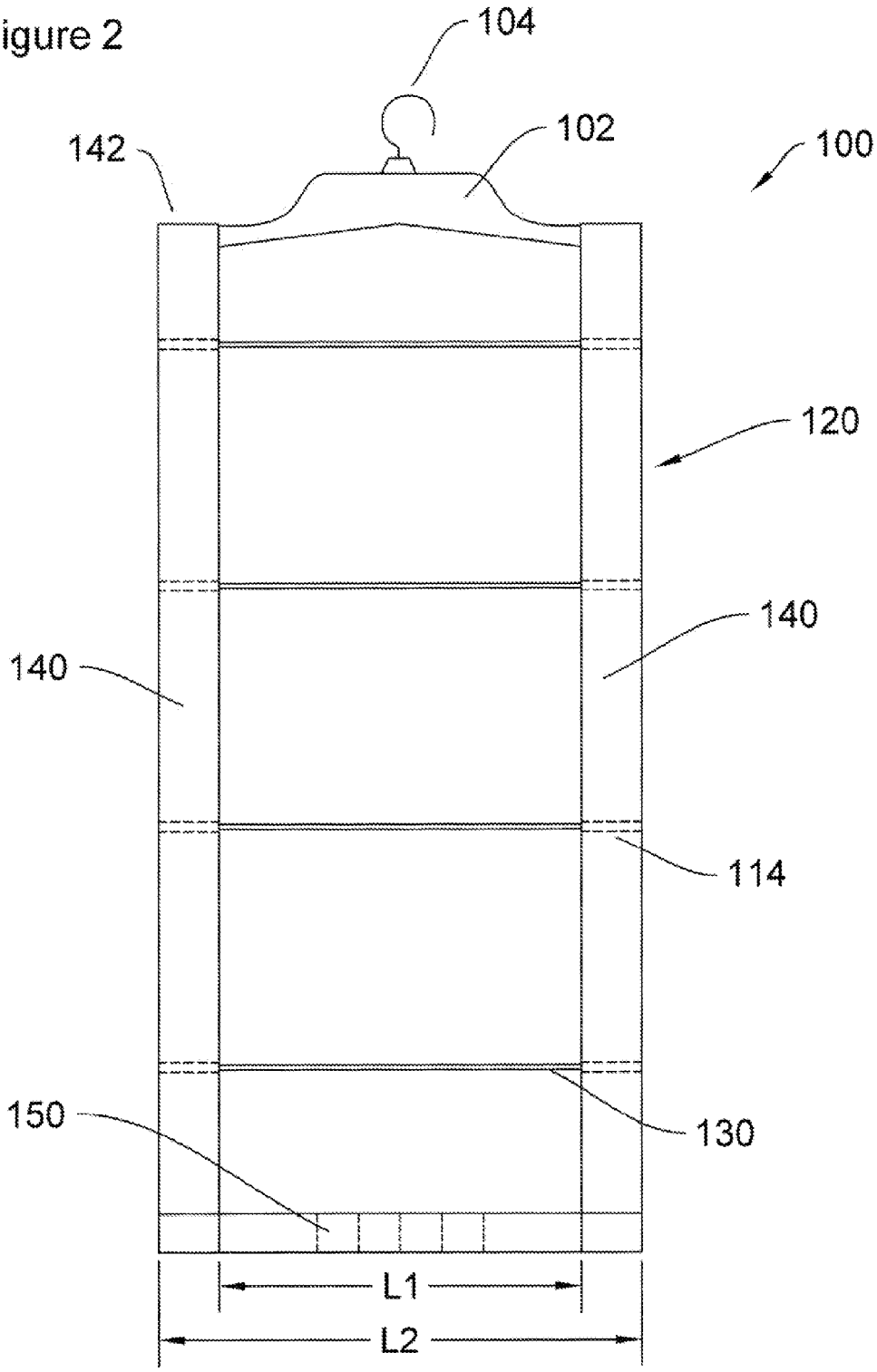
FIG. 2 shows the other side of the device.

FIG. 1 illustrates a preferred embodiment of a device 100 using the invention. The device 100 is a jewelry organizer that includes a hanger 102 that includes a hanging hook 104 that swivels so that the organizer 100 can be hung from a closet rod or from the back of a door (see D FIG. 3) for example. The organizer 100 includes a flexible body 110 such as a fabric body. The flexible body 110 is made from a decorative fabric or material. The flexible body 110 can be a fabric surface and can have two sides, the back side 112 shown in FIG. 1 is primarily decorative. The flexible body 110 includes stitched pockets 114 that are open on the front side 120 (FIG. 2). Although the flexible body 110 is flexible it generally hangs in a planar form as shown in FIG. 1.

FIG. 2 shows the organizer 100 fabric surface front side 120. The fabric surface front side 120 includes a plurality of metal wood or plastic bars 130 horizontally supported in pockets 114. The length of each bar 130 is longer than L1 but shorter than L2 such that the bars 130 can be slipped in and out of the pockets 114 but once mounted as shown in FIG. 2 will stay in place until purposely removed. The pockets 114 are formed in flaps 140 on each edge of the front side 120. The flaps 140 also are attached and closed at the top 142 such that the hanger 102 is removably held in the organizer 100. The length L2 is approximately the same as a clothing hanger. Based on this design the hanger 102 can be a standard clothing hanger or a custom hanger with a swivel hook 104. The front side 120 also includes pockets 150 that are open on their top edges across the bottom of the organizer 100.

Figure 3:
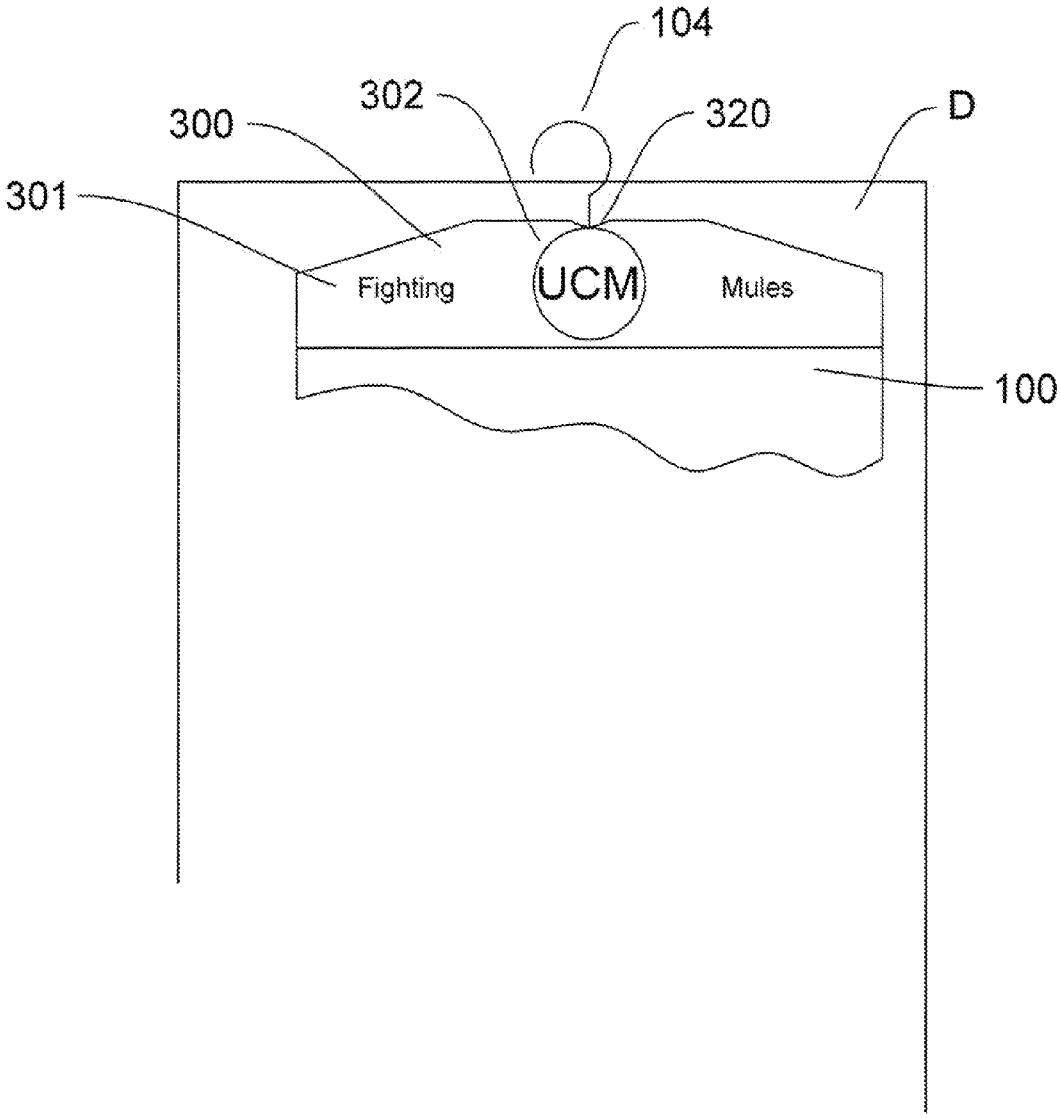
FIG. 3 shows an accessory.

FIG. 3 shows a partial view of an organizer 100 hung from a door D with swivel hook 104 swiveling out of the plane generally defined by the flexible body. The organizer 100 can include a decorative and removable top cover 300. The cover 300 can include indicia 301 and a graphic image 302 such as a logo or a picture of a celebrity for example. The cover 300 slips over the top of the organizer 100 and includes an opening 320 that allows the hook 104 to pass through.

Figure 4:
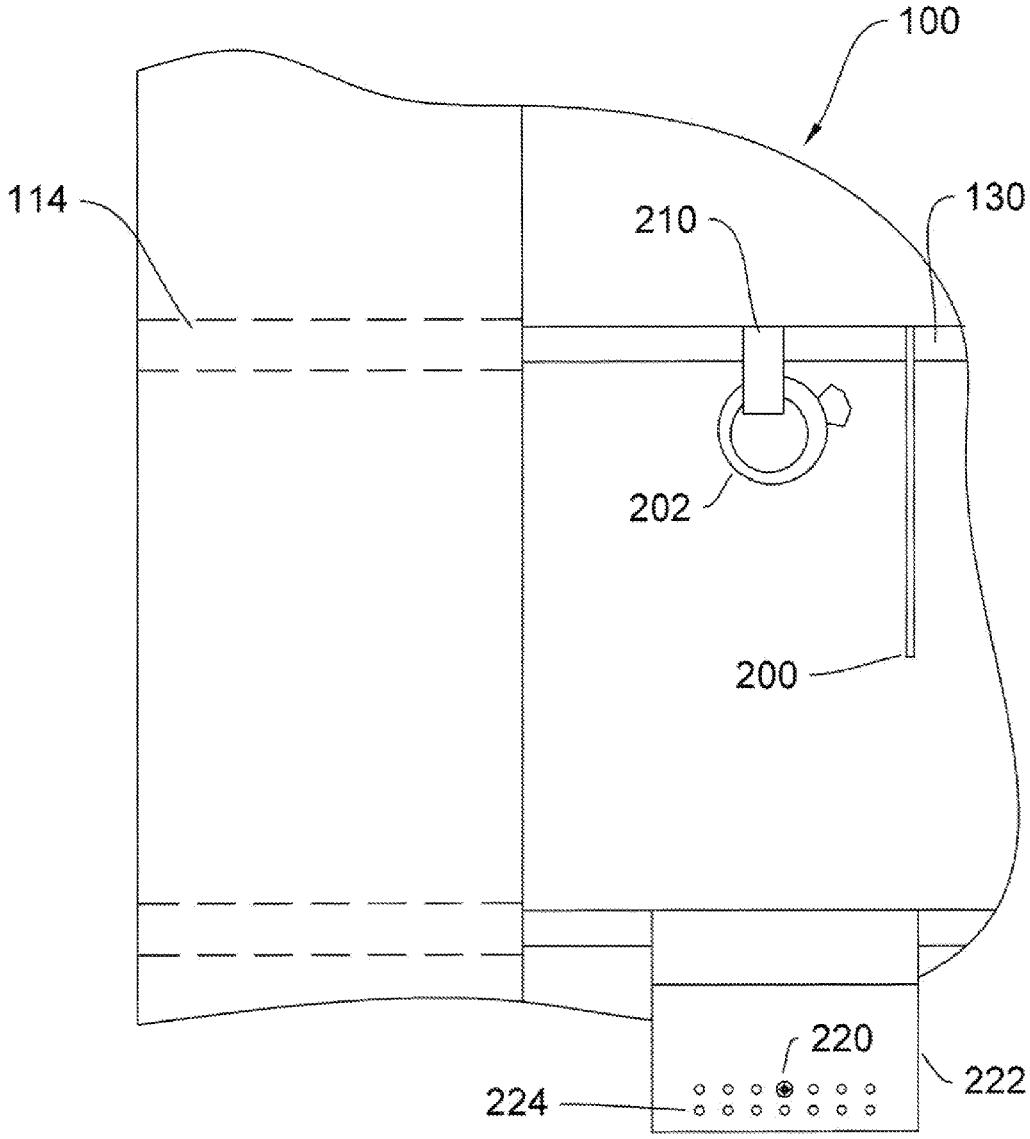
FIG. 4 shows a close up of a portion of the device and accessories.

FIG. 4 shows a partial view of the organizer 100 and shows details of the organizer device 100. The organizer 100 includes sewn pockets 114 and support rods 130. Some jewelry items such as necklaces or bracelet 200 includes clasps that allow them to be opened and hung on the rod 130. Other jewelry such as ring 202 do not have openings and thus require a hanger such as a small hook or strip of fabric 210 that can be closed with a loop pile fastener (See FIG. 5) to form a closed loop around the rod 130. Small items such as non-clip or post earrings 220 will require a container such as a pocket 150 or a surface 222 with a plurality of small holes 224 that allow the earrings to be mounted and organized thereon.

Figure 5:
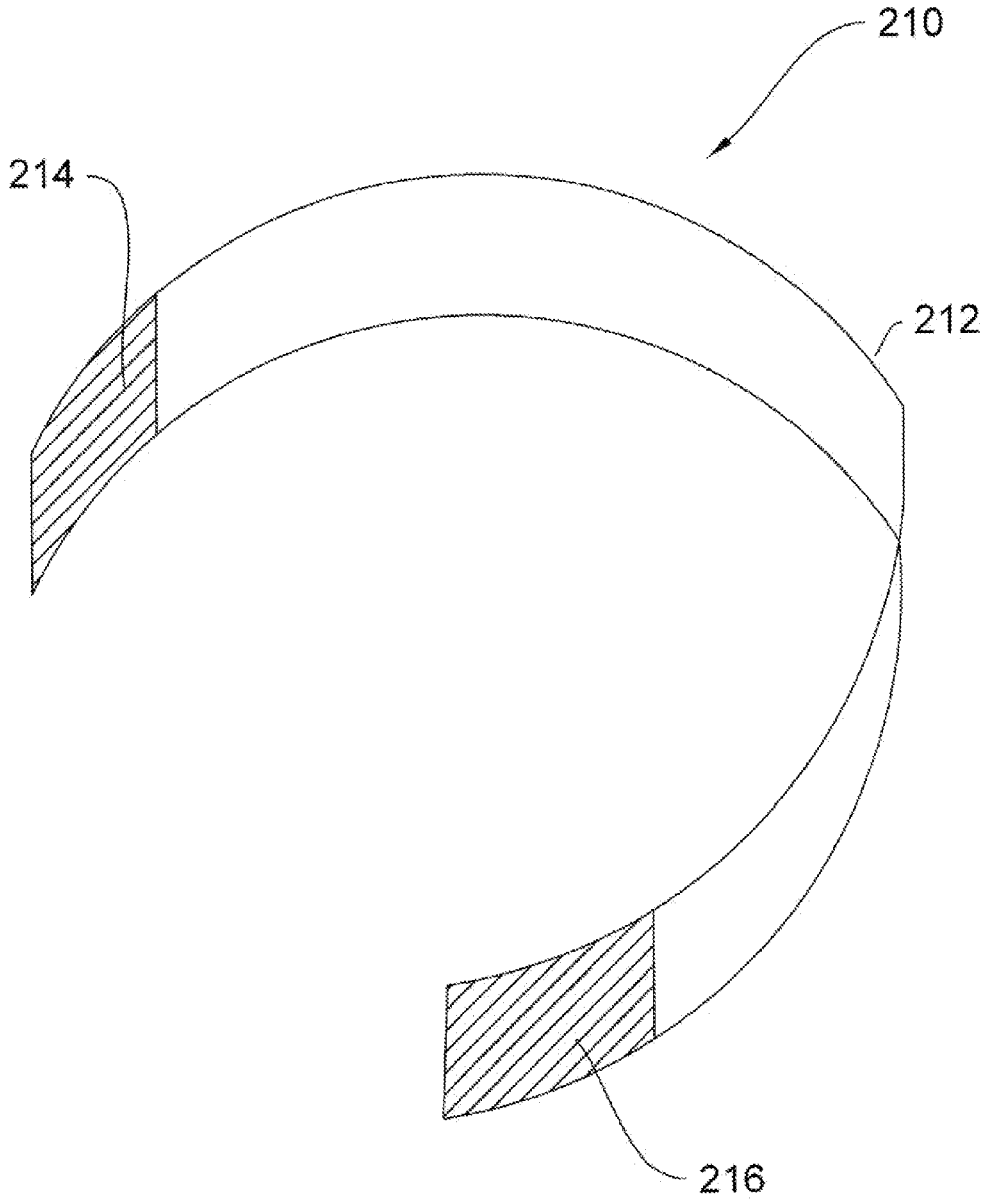
FIG. 5 shows details.

FIG. 5 shows the fabric loop 210 includes a flexible fabric portion 212, a loop fastener portion 214 on one end and a fabric fastener portion 216.

Figure 6:
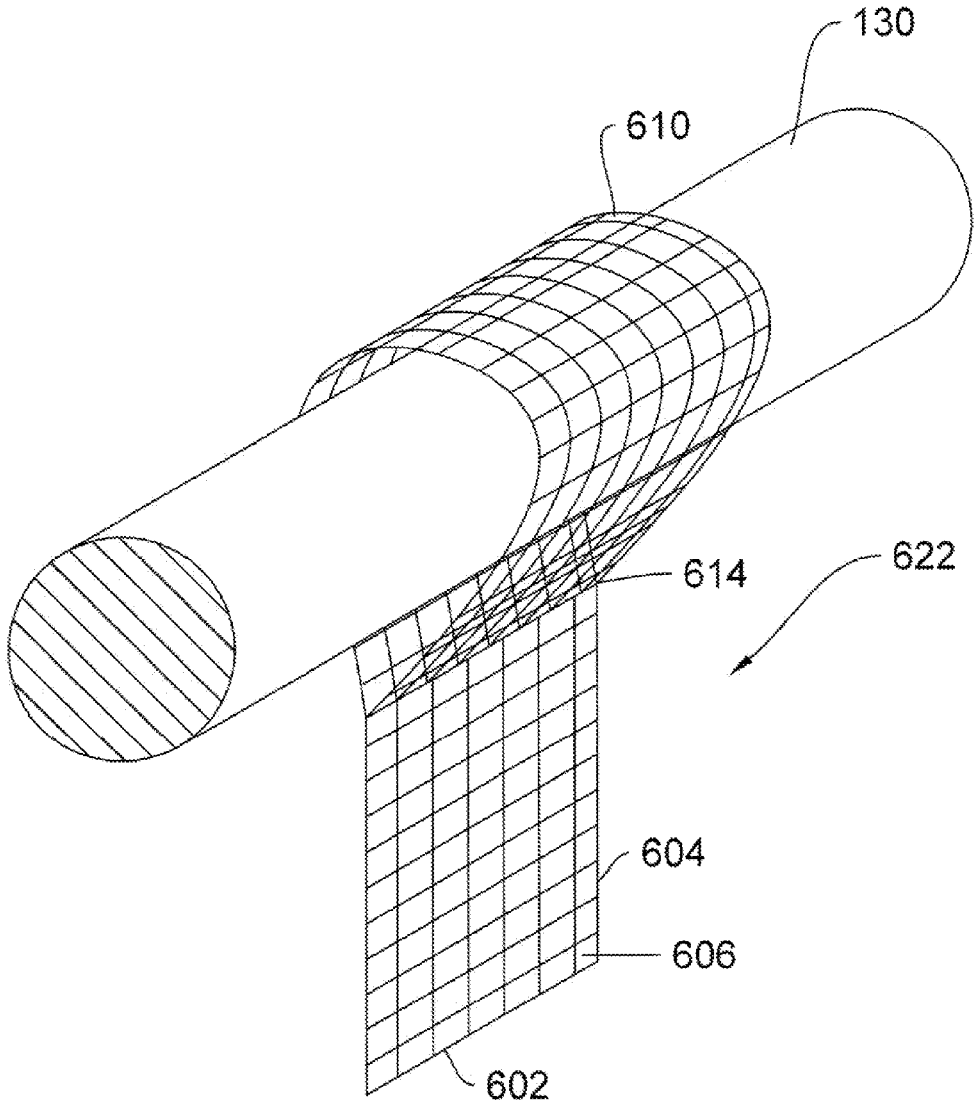
FIG. 6 shows details of the device.

FIG. 6 shows details of a mesh hanger 622 on a wire rod 130. The mesh hanger 622 is flexible and can bend over the rod 130 and connect to itself at connection 614. The hanger 622 can include a plurality of long filaments 604 and cross filaments 602 that form a plurality of openings 606 that allow items like earrings for pierced ears to be connected to the hanger 622.

In use the hanger 102 can be inserted into closures 142 at the top edge of the organizer 100. The organizer 100 can then be hung from a door or clothing rod for example to display jewelry held on its surface. A decorative top cover 300 can be placed over the top of the organizer to cover and hide the hanger 102. Bars 130 can be placed into pockets 114 and the bars 130 are supported in a horizontal orientation such that jewelry may be directly hung from the bars 130 or support accessories such as hooks, pockets 150, loops 210 or surfaces 222 can be supported from the fabric surface or from the bars 130. Although the device 100 would typically be used in the closet, it is decorative enough to be displayed anywhere. Because the body 110 is flexible the organizer device 100 can be rolled up into a roll, with rods 130 and jewelry in place, for travel.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. A fabric jewelry organizer including:

a fabric surface having a respective fabric flap on each of a left edge and a right edge;

a plurality of horizontal pockets formed by each of the flaps;

a plurality of horizontal support bars mounted in corresponding, opposing said pockets of the flaps;

a respective closure defined at a top edge of each flap and a hanger held in said organizer by said closures such that said hanger can be used to support the organizer.

2. The jewelry organizer of claim 1 wherein said hanger includes a hanger body held in a planar surface of said fabric surface and said hanger includes a swivel hook.

3. The jewelry organizer of claim 2 wherein said organizer includes a top cover that slips over said hanger to cover said hanger and wherein said top cover includes an opening for said swivel hook and wherein said top cover includes a graphic image.

4. The jewelry organizer of claim 1 including a plurality of loops including loop pile fasteners.

5. A fabric jewelry organizer including:

a fabric surface having a top edge, a bottom edge and two opposing left side and right side edges, and a plurality of horizontal pockets formed adjacent each side edge;

a plurality of horizontal support bars mounted in opposing respective said pockets;

a closure defined at said top edge of said fabric surface and a hanger held in said organizer by said closure such that said hanger can be used to support the organizer.

6. The organizer of claim 5 wherein said hanger includes a hanger body held in a planar surface of said fabric surface and said hanger includes a swivel hook.

7. The organizer of claim 6 wherein said organizer includes a top cover that slips over said hanger to cover said hanger and wherein said top cover includes an opening for said hook and wherein said top cover includes a graphic image.

8. The organizer of claim 5 including a plurality of loops including loop pile fasteners.

9. An organizer including:

a fabric surface having a top edge, a bottom edge and two opposing left side and right side edges, and a plurality of horizontal pockets formed adjacent each side edge;

pairs of pockets opposedly aligned across said surface and each pocket respectively adjacent one of said left side edge and said right side edge;

a plurality of horizontal support bars, one said bar mounted in each aligned pair of pockets;

a closure defined at a top edge of said fabric surface and a hanger held in said organizer by said closure such that said hanger can be used to support the organizer.

10. The organizer of claim 9 wherein said hanger includes a hanger body held in a planar surface of said fabric surface and said hanger includes a swivel hook.

11. The organizer of claim 10 wherein said organizer includes a top cover that slips over said hanger to cover said hanger and wherein said top cover includes an opening for said hook and wherein said top cover includes a graphic image.

12. The organizer of claim 11 including a plurality of loops including loop pile fasteners.

* * * * *